US011322855B2

(12) United States Patent
Jessie et al.

(10) Patent No.: US 11,322,855 B2
(45) Date of Patent: May 3, 2022

(54) SLOW-WAVE RF TRANSMISSION NETWORK

(71) Applicant: QUALCOMM Incorporated, San Diego, CA (US)

(72) Inventors: Darryl Sheldon Jessie, San Diego, CA (US); Mina Iskander, San Diego, CA (US); Avantika Sodhi, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 115 days.

(21) Appl. No.: 16/748,707

(22) Filed: Jan. 21, 2020

(65) Prior Publication Data

US 2021/0226340 A1 Jul. 22, 2021

(51) Int. Cl.
*H01Q 21/00* (2006.01)
*H01Q 19/02* (2006.01)

(52) U.S. Cl.
CPC ..... *H01Q 21/0075* (2013.01); *H01Q 19/021* (2013.01)

(58) Field of Classification Search
CPC .. H01Q 21/0075; H01Q 13/206; H01Q 13/08; H01Q 19/021
See application file for complete search history.

(56) References Cited

U.S. PATENT DOCUMENTS 4,740,794 A * 4/1988 Phillips ..... H04B 1/40 343/702
2019/0280385 A1* 9/2019 Suematsu ..... H01Q 1/525
2019/0393729 A1* 12/2019 Contopanagos ..... H01Q 21/24
2020/0403322 A1* 12/2020 Ryu ..... H01Q 3/26

OTHER PUBLICATIONS

Chang W.S., et al., "A High Slow-Wave Factor Microstrip Structure with Simple Design Formulas and Its Application to Microwave Circuit Design", IEEE Transactions on Microwave Theory and Techniques, vol. 60, No. 11, Nov. 2012, pp. 3376-3383.
Orellana M., et al., "Synthesis of Slow-Wave Structures Based on Capacitive-Loaded Lines Through Aggressive Space Mapping (ASM)", International Journal of RF and Microwave Computer-Aided Engineering, vol. 25, No. 7, Sep. 2015, pp. 629-638.

* cited by examiner

*Primary Examiner* — Awat M Salih
(74) *Attorney, Agent, or Firm* — Haynes and Boone, LLP

(57) ABSTRACT

A transmission line network is provided that includes a slow-wave transmission line to couple a first terminal to a first antenna. The transmission line network also includes a conventional transmission line to couple a second terminal to a second antenna.

20 Claims, 6 Drawing Sheets

SLOW-WAVE RF TRANSMISSION NETWORK

TECHNICAL FIELD

This application relates to RF frontends, and more particularly to a slow-wave structure for an RF frontend.

BACKGROUND

To support the high data rates for modern cellular communication protocols such as the fifth generation (5G) cellular network technology, the transmission spectrum is being expanded to the millimeter wave regime. Due to the smaller wavelength size at these higher frequencies, the base station and mobile devices may each incorporate an array of antennas despite the mobile devices having a relatively small form factor. The RF transceiver driving the antenna array may be integrated within an RF integrated circuit mounted to a circuit board whereas the antennas are typically formed in metal layers deposited on the circuit board or in a module mounted on the circuit board. The routing between the antennas and the RF integrated circuit becomes congested and problematic.

Accordingly, there is a need in the art for improved antenna routing networks.

SUMMARY

In accordance with a first aspect of the disclosure, an antenna array is provided that includes: a substrate including a first terminal and a second terminal; a first antenna; a second antenna; a first transmission line extending between the first terminal and the first antenna, wherein the first transmission line includes a first lead adjacent a first ground plane, and wherein the first lead is configured to provide the first transmission line with a first phase velocity; and a second transmission line extending between the second terminal and the second antenna, wherein the second transmission line includes a second lead adjacent the first ground plane, and wherein the second lead has a periodic structure configured to provide the second transmission line with a second phase velocity that is less than the first phase velocity.

In accordance with a second aspect of the disclosure, a method for an antenna array is provided that includes: propagating a first RF signal at a first phase velocity from a transceiver through a first transmission line to a first antenna; and propagating the first RF signal at a second phase velocity from the transceiver through a second transmission line at a second phase velocity that is greater than the first phase velocity by a slow-wave factor, wherein an electrical length of the first transmission line equals an electrical length of the second transmission line.

In accordance with a third aspect of the disclosure, an antenna array is provided that includes: a substrate including a first terminal and a second terminal; a first antenna and a second antenna adjacent the substrate, wherein the first antenna is separated from the first terminal by a first distance, and wherein the second antenna is separated from the second terminal by a second distance that is less than the first distance; a fast-wave transmission line extending from the first terminal to the first antenna; and a slow-wave transmission line extending from the second terminal to the second antenna.

These and other advantageous features may be better appreciated through the following detailed description.

BRIEF DESCRIPTION OF THE DRAWINGS

Embodiments of the present disclosure and their advantages are best understood by referring to the detailed description that follows. It should be appreciated that like reference numerals are used to identify like elements illustrated in one or more of the figures.

DETAILED DESCRIPTION

Figure 1:
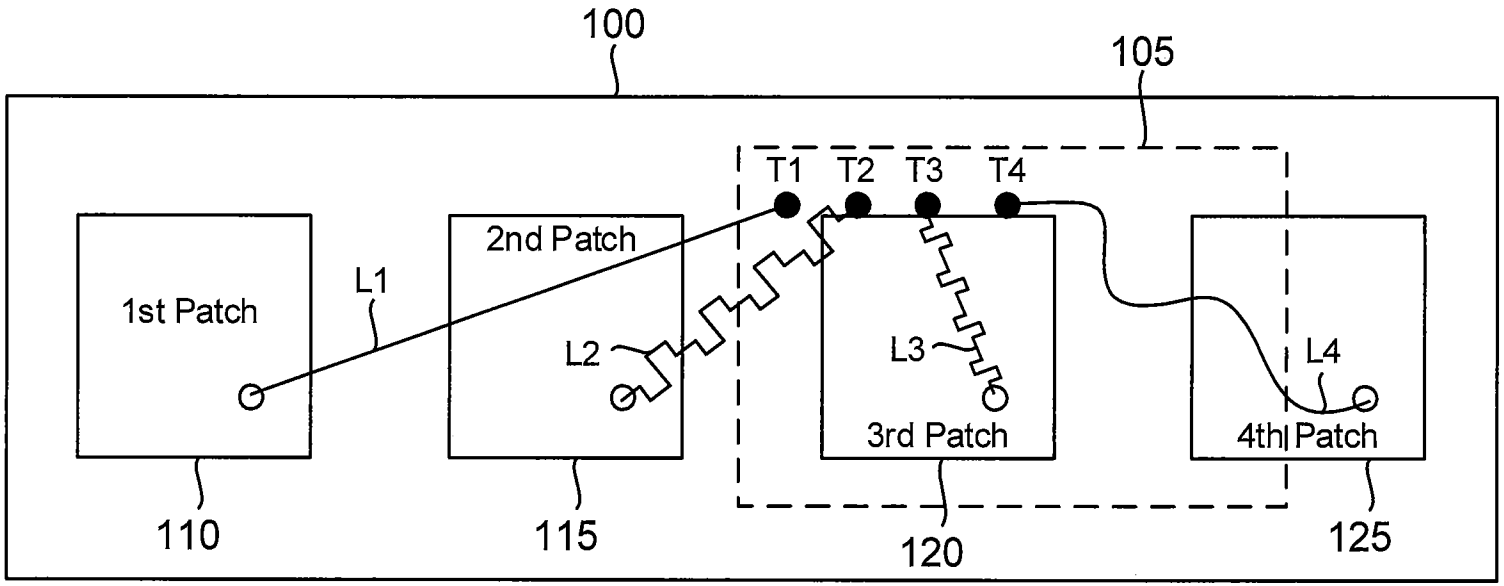
FIG. 1 illustrates a substrate including a plurality of antennas coupled to an RFIC through a transmission line network that includes both conventional and slow-wave transmission lines in accordance with an aspect of the disclosure.

The routing from an RF integrated circuit (RFIC) to a plurality of antennas in an array requires a separate transmission line between the RFIC and each individual antenna. The following discussion will assume that the transmission lines are formed in metal layers deposited on a circuit board substrate that also includes the antenna array, but it will be appreciated that the antenna array and the corresponding transmission lines may be formed in metal layers deposited on a semiconductor die for the RFIC.

The transmission lines begin at pins or terminals on the circuit board that are connected to corresponding pins or terminals on the RFIC. For example, the circuit board may include a first circuit board terminal that connects to a first terminal of the RFIC. A first transmission line extends from the first circuit board terminal to a first antenna in the antenna array. Similarly, a second transmission line extends from a second circuit board terminal to a second antenna in the antenna array and so on. Each of the transmission lines has the same electrical length so that an RF signal that is being transmitted (or received) is subjected to the same phase change as the RF signal propagates the length of the transmission line.

For a transmission line, the electrical length is a function of the delay for the RF signal to traverse the physical length of the transmission line. That delay in turn is a function of the phase velocity for the transmission line. In a simple lead such as a copper wire, the phase velocity of the RF signal is the speed of light. But in transmission lines such as a microstrip line, the phase velocity of the RF signal is lower than the speed of light by a velocity factor. As the velocity factor for a transmission line is reduced, the electrical length at a given RF frequency increases. In a conventional transmission line network for driving an antenna array, each transmission line has the same phase velocity. For example, the antennas that is physically most-remote from its corresponding circuit board pin requires a correspondingly-long transmission line to extend from the circuit board pin to this most-remote antenna. The transmission line to the antenna that is closest to its corresponding circuit board pin needs to have the same electrical length as the longest transmission line. To achieve this electrical length over such a relatively short distance requires the shorter transmission lines to meander so that they achieve the required electrical length despite the relatively-short distance between the corresponding circuit board pin and antenna. The commonality of phase velocity for the various transmission lines thus leads to routing congestion since the transmission lines to the relatively-adjacent antennas must meander.

The transmission line networks disclosed herein address this routing congestion through the selective use of slow-wave transmission lines. As used herein, a "slow-wave" transmission line is understood to include a periodic structure that reduces the phase velocity as compared to a conventional transmission line. A conventional transmission line is also denoted herein as a fast-wave transmission line. The selective use of the slow-wave transmission lines applies to the circuit board terminals that are relatively close to their corresponding antennas whereas the remaining transmission lines to the more remotely-located antennas in the array are conventional (fast-wave). As compared to the physical length of a conventional transmission line having the same electrical length, a slow-wave transmission line is considerably shorter. This selective use of slow-wave transmission lines is thus quite advantageous as the routing congestion is alleviated since the slow-wave transmission lines can be relatively short and thus span the relatively-short distance between a relatively-close circuit board terminal and the corresponding antenna without the meandering that a conventional transmission line would require to achieve the required electrical length. In addition, the use of conventional transmission lines to route to the more distantly-located antennas in the array saves power as compared to the use of a slow-wave transmission line spanning the same physical length.

An example antenna array and transmission line network are shown in FIG. 1. A substrate 100 such as a circuit board substrate supports an array of four patch antennas ranging from a first patch antenna 110 to a fourth patch antenna 125. It will be appreciated that alternative embodiments may use other types of antennas such as dipole antennas or fractal antennas. Each antenna couples to a transceiver such as implemented in an RFIC 105 through a corresponding transmission line and circuit board terminal. For example, first patch antenna 110 couples through a first transmission line L1 to a first circuit board terminal T1. A second patch antenna 115 couples through a second transmission line L2 to a second circuit board terminal T2. A third patch antenna 120 couples through a third transmission line L3 to a third circuit board terminal T3. Finally, fourth patch antenna 125 couples through a fourth transmission line to a fourth circuit board terminal T4. Each circuit board terminal couples to a corresponding pin or terminal (not illustrated) on RFIC 105. Using the transmission lines, RFIC 105 can thus drive RF signals to the four patch antennas and also receive RF signals from the four patch antennas.

Due to the location of RFIC 105 relative to substrate 100, the circuit board terminals and their corresponding patch antenna are separated by a range of distances. For example, first patch antenna 110 is relatively remote from its circuit board terminal T1 whereas second patch antenna 115 is relatively adjacent to its circuit board terminal T2. Similarly, third patch antenna 120 is also relatively adjacent to its circuit board terminal T3. Fourth patch antenna 125 is relatively more remote from its circuit board terminal T4 but not as remotely-located as first patch antenna 110. The physical length of each transmission line and its phase velocity determine its electrical length. The transmission line to the most remotely-located antenna such as the first transmission line L1 thus establishes a maximum electrical length that should be matched by all the remaining transmission lines.

Since the first transmission line L1 extends across substrate 100 relatively remotely from RFIC 105, the first transmission line L1 is not subjected to routing congestion as compared to the second transmission line L2 or as compared to the third transmission line L3. The first transmission line L1 can thus have a conventional, non-periodic configuration. To achieve the same electrical length as for the first transmission line L1, the fourth transmission line L4 may meander. Although the fourth transmission line meanders, this meandering does not affect the characteristic impedance such that both the first transmission line L1 and the fourth transmission line L4 have the same characteristic impedance that equals a square root of a ratio L/C, where L is the inductance per unit length for the first (or the fourth) transmission line L1 and C is the capacitance per unit length for the first (or the fourth) transmission line L1.

The phase velocity for a transmission line equals a ratio of 1 to a square root of a product of the inductance and capacitance. The phase velocity for the first transmission line L1 and for the fourth transmission line L4 thus equals $1/\sqrt{(LC)}$. If the second transmission line L2 and the third transmission line L3 have the same conventional, non-periodic structure as for the first transmission line L1, the second transmission line L2 and the third transmission line L3 would both have to meander as shown for the fourth transmission line L4 so that the transmission lines all have the same electrical length. But note that RFIC 105 requires routing for power, ground, and for additional signals. The routing for these additional signals (not illustrated) may result in routing congestion should the second transmission line L2 and the third transmission line L3 also have a conventional meandering configuration. To alleviate this routing congestion, second transmission line L2 and third transmission line L3 are both slow-wave transmission lines. In these slow-wave transmission lines, the phase velocity is less than the phase velocity for the conventional transmission lines. The phase velocity is reduced when the capacitance and/or the inductance for the slow-wave transmission lines is increased as compared to the conventional transmission lines. This increase in capacitance and/or inductance results from a periodic structure for the slow-wave lines.

Figure 2A:
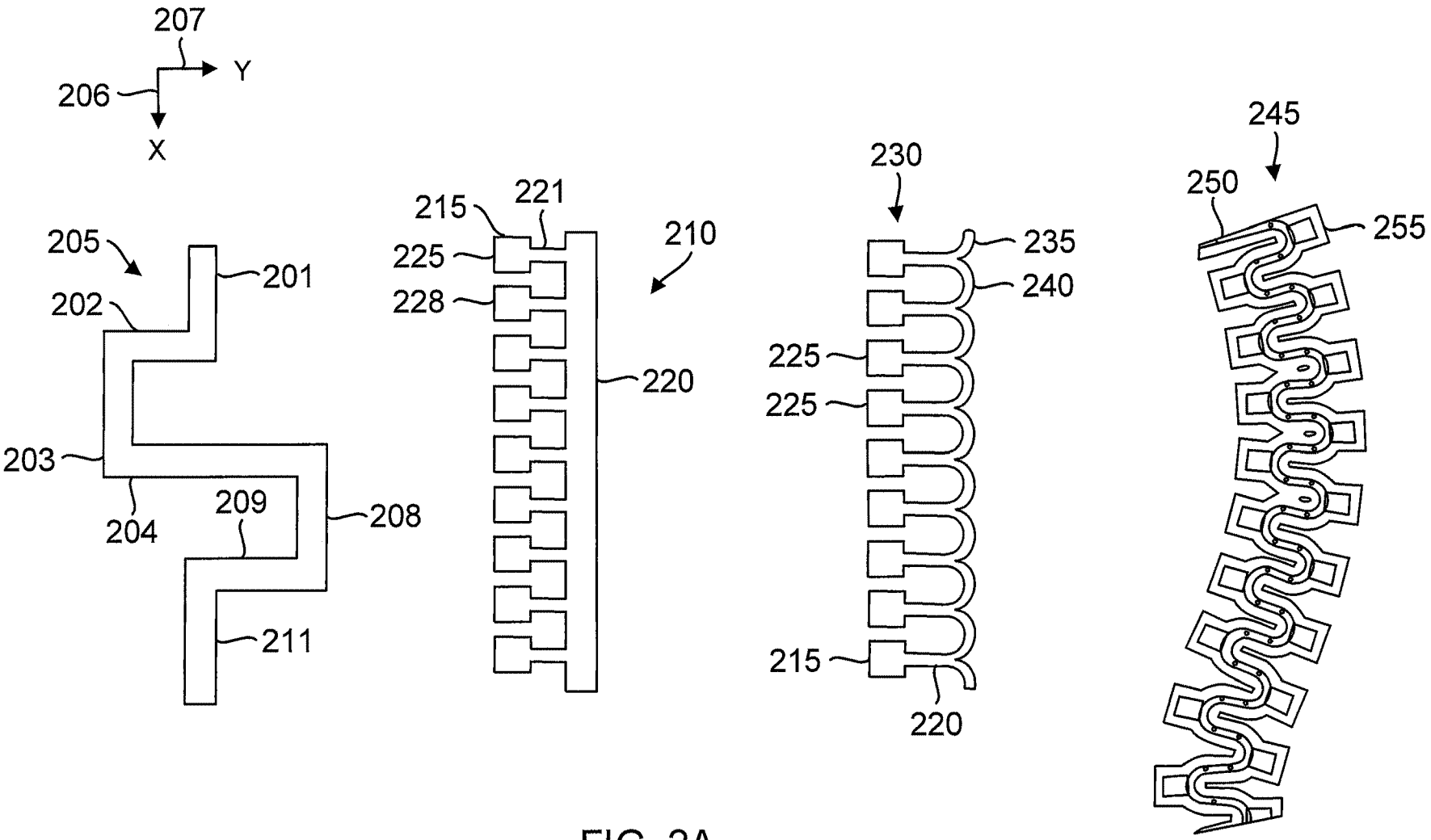
FIG. 2A illustrates some example slow-wave transmission line topologies for a transmission line network in accordance with an aspect of the disclosure.

Some example periodic structures for slow-wave transmission lines are shown in FIG. 2A. To increase the capacitance and inductance, a slow-wave transmission line 205 has a "tight" meander. Such a tight meander is distinguished from a conventional meander such as shown for the fourth transmission line L4 because a tight meander increases the capacitance and inductance per unit length as compared to the corresponding capacitance and inductance for a conventional transmission line having the same lead width. Regardless of whether the transmission line is a microstrip, a stripline, or a coplanar waveguide, the RF signal propagates in a metal layer that is patterned to form a lead. For example, the lead width for a slow-wave transmission line 205 is 25 microns. In general, the lead width depends upon the RF frequency, the desired characteristic impedance, and other factors. It will thus be appreciated that the lead width may be less than or greater than 25 microns in alternative embodiments. To produce the tight meander, slow-wave transmission line 205 alternates between longitudinal leads and transverse leads. For example, a first longitudinally-extending lead 201 extends for 87.5 microns to connect to a transverse lead 202. In a cartesian coordinate system, the longitudinal leads may all be deemed to extend along a positive x axis 206 (the longitudinal axis) whereas the transverse leads alternate between extending along the negative y axis (not illustrated) and extending along a positive y axis 207. More generally, a longitudinal axis for the transverse leads is orthogonal to a longitudinal axis for the longitudinal leads.

Transverse lead 202 extends for 75 microns in the negative y direction to connect to a longitudinal lead 203 having a length of 100 microns. Longitudinal lead 203 connects to a transverse lead 204 that extends in the positive y direction for 175 microns to connect to another longitudinal lead 208 having a length of 100 microns. Longitudinal lead 208 connects to a transverse lead 209 that extends in the negative y direction for 100 microns to connect to a longitudinal lead 211 having a length of 112.5 microns. Leads 201 through 211 form a periodic structure that is repeated in slow-wave transmission line 205. Lead 211 would thus connect to another lead 201 (not illustrated) that in turn connects to another lead 202 (not illustrated), and so on. Since the transverse leads 202, 204, and 209 are merely separated by 100 microns, they increase the unit capacitance for slow-wave transmission line 205 as compared to a conventional transmission line including a straight lead of the same width (25 microns). Similarly, the looping caused by the alternation between the positive y and negative y directions for the transverse leads increases the unit inductance for slow-wave transmission line 205 as compared to such a conventional transmission line.

From the beginning of longitudinal lead 201 to the end of longitudinal lead 211, slow-wave transmission line 205 extends 475 microns. Due to the capacitive and inductive loading from the tight meander for slow-wave transmission line 205, the phase rotation for an RF signal having a frequency of 35 GHz is approximately 1.6 times the phase rotation for a conventional transmission line formed by a non-periodic lead of the same width (in this embodiment, 25 microns) and having the same length of 475 microns. Per unit length of slow-wave transmission line 205, the corresponding electrical length is 1.6 times longer than the electrical length per unit length of a conventional transmission line. It will be appreciated that the lengths of the transverse and longitudinal leads in slow-wave transmission line 205 are merely exemplary and may be modified in alternative embodiments.

As noted earlier, the characteristic impedance of a transmission line is a function of a ratio of its inductance per unit length to its capacitance per unit length. In slow-wave transmission line 205, the tight meander was designed such that the unit-length inductance and capacitance both increased by the same amount. This is advantageous as the characteristic impedance (e.g., 50Ω) for slow-wave transmission line 205 is unchanged from the characteristic impedance for a conventional transmission line having the same lead width. But slow-wave transmission lines may be formed in which it is just the capacitance (or inductance) per unit length that is increased. For example, a slow-wave transmission line 210 includes a longitudinal main lead 220 that extends in the longitudinal direction and has a width of 25 microns. Without any further modifications, main lead 220 would result in a conventional transmission line structure. But main lead 220 is loaded by a plurality of capacitive stubs 225. Each capacitive stub includes a transverse lead 221 that extends orthogonally to the longitudinal axis for main lead 220 and ends in a square patch 215. Capacitive stubs 225 increase the capacitance per unit length for slow-wave transmission line 205 to be twice that of a conventional transmission line formed only by main lead 220. Since the inductance is not significantly affected, the characteristic impedance for slow-wave transmission line 210 is reduced as compared to such a conventional transmission line.

To keep the characteristic impedance the same as a comparable (same lead width) conventional transmission line, a slow-wave transmission line 230 includes a plurality of capacitive stubs 225 as discussed for slow-wave transmission line 210 but in which a main lead 235 is no longer a straight longitudinal backbone but instead meanders between each capacitive stub 225. In particular, main lead 235 forms a plurality of arcs 240 so that each arc 240 connects to adjacent transverse leads 220. Each arc 240 increases the inductance per unit length by the same factor that capacitive stubs 225 increase the capacitance per unit length such that the characteristic impedance for slow-wave transmission line 230 is unchanged as compared to a conventional transmission line formed by a longitudinally-extending lead having the same width as main lead 235. In an alternative slow-wave transmission line 245, the arcs for a main lead 250 may alternate in a transverse fashion such that main lead 250 has a switchback configuration. In slow-wave transmission line 245, each capacitive stub 255 connects to an apex of a corresponding arc in main lead 250.

Figure 2B:
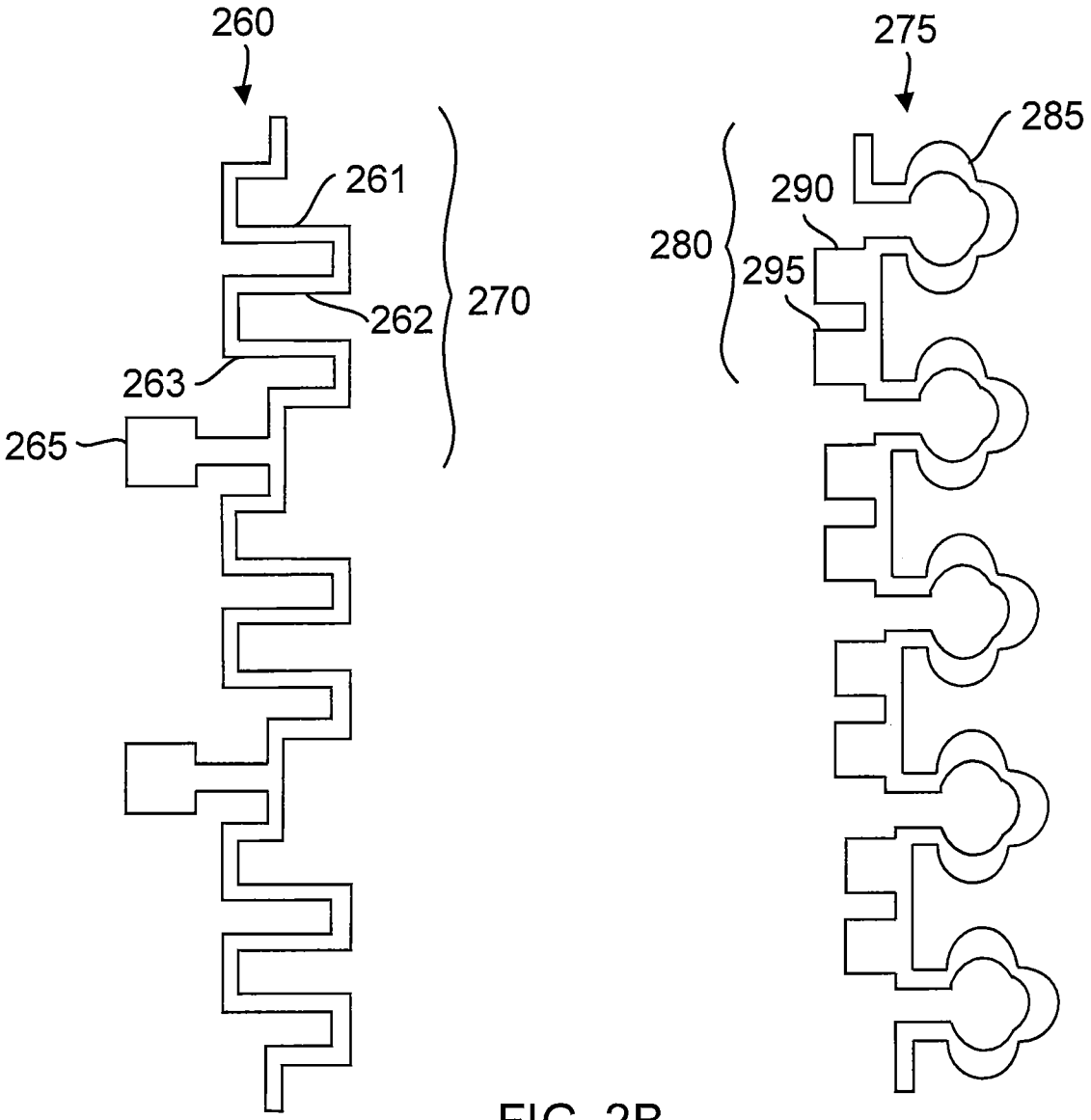
FIG. 2B illustrates some additional example slow-wave transmission line topologies for a transmission line network in accordance with an aspect of the disclosure.

Another example slow-wave transmission line 260 is shown in FIG. 2B in addition to an example slow-wave transmission line 275. Slow-wave transmission line 260 is formed by a periodic repetition of slow-wave structures or cells 270. Each cell 270 includes an odd number (in this embodiment, three) of transverse leads 261, 262, and 263. The odd number increases the mutual inductance between the transverse leads so as to desirably boost the overall inductance for slow-wave transmission line 260. To increase the capacitance so that the characteristic impedance remains substantially unchanged from a comparable conventional transmission line, each cell 270 includes at least one capacitive stub 265.

Slow-wave transmission line 275 is formed by a periodic repetition of slow-wave cells 280 (for illustration clarity, only one cell 270 and one cell 280 is annotated in FIG. 2B). Each cell 280 includes a fractal arc 285. In cell 280, fractal arc is a three-order fractal arc but it will be appreciated that other fractal orders may be implemented. Each cell 280 includes a first capacitive stub 290 and a second capacitive stub 295 to balance the increase in inductance from fractal arc 285 with a corresponding increase in capacitance.

Figure 3:
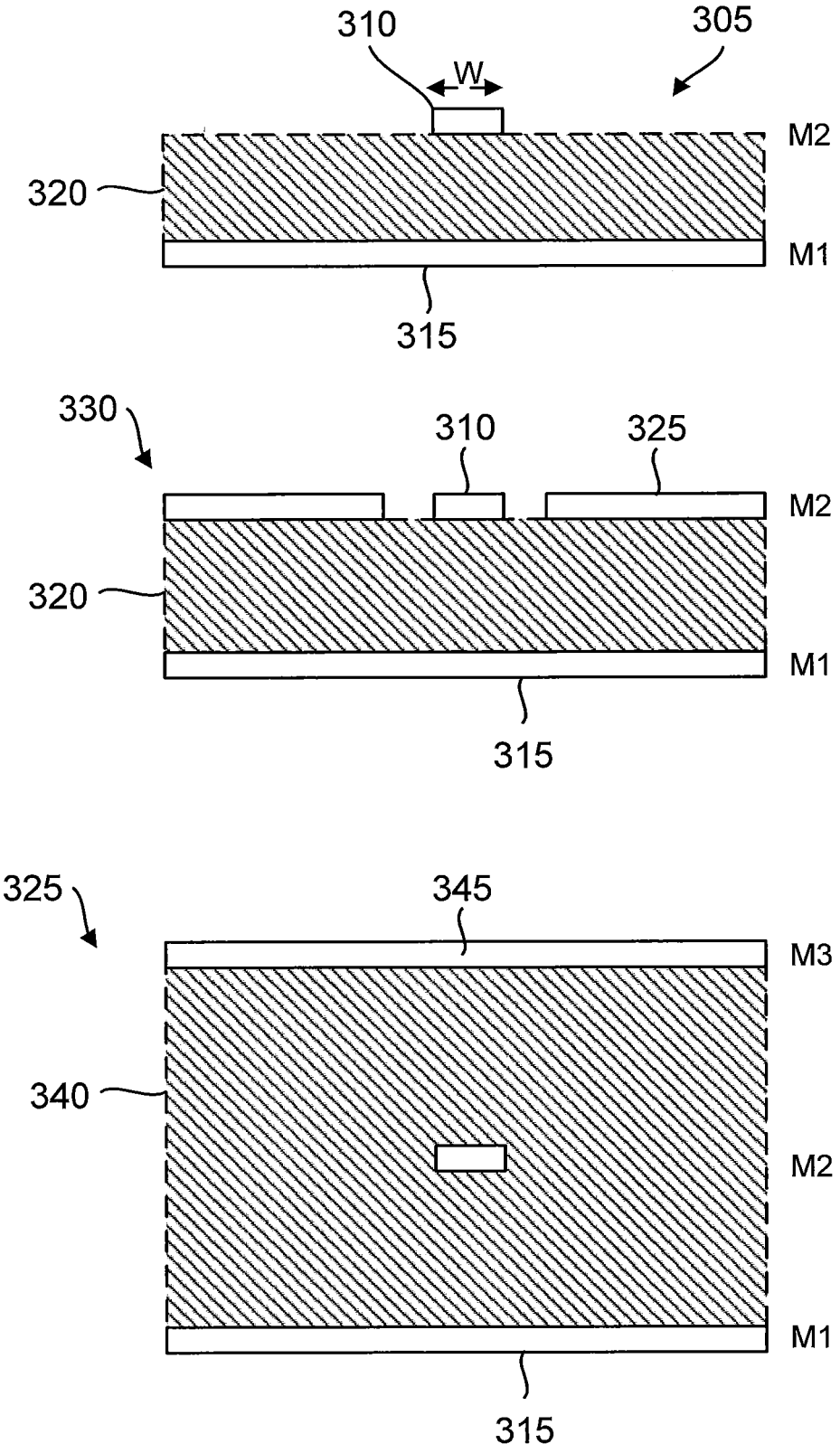
FIG. 3 illustrates a microstrip, a co-planar waveguide, and a stripline configuration for a transmission line network in accordance with an aspect of the disclosure.

The transmission lines disclosed herein are formed in metal layers on substrate 100 that are separated by corresponding dielectric layers. A microstrip transmission line 305 is shown in cross-section in FIG. 3. A lead 310 has a width W and is separated from a ground plane 315 be a dielectric layer 320. Ground plane 315 is formed in a first metal layer M1 whereas lead 310 is formed in an adjacent metal layer M2. The patterning of metal layers such as through lithographic techniques to form lead 310 and ground plane 315 is well known and thus will not be discussed further herein. Depending upon the patterning of lead 310, microstrip transmission line 310 forms a conventional transmission line such as first transmission line L1 or a slow-wave transmission line such as discussed with regard to FIGS. 2A and 2B.

To increase the shielding of lead 310, second metal layer M2 may also be patterned to form a second ground plane 325 that surrounds lead 310 in a co-planar waveguide 330. Dielectric layer 320 and ground plane 315 are as discussed for microstrip transmission line 305. Even greater shielding in produced by covering lead 310 with another ground plane 345 formed in an adjacent metal layer M3 in a stripline 335. A dielectric layer 340 extends between ground plane 315 and ground plane 345. Depending upon the patterning of lead 310, co-planar waveguide 330 and stripline 335 form either a conventional transmission line such as first transmission line L1 or a slow-wave transmission line such as discussed with regard to FIGS. 2A and 2B.

Figure 4:
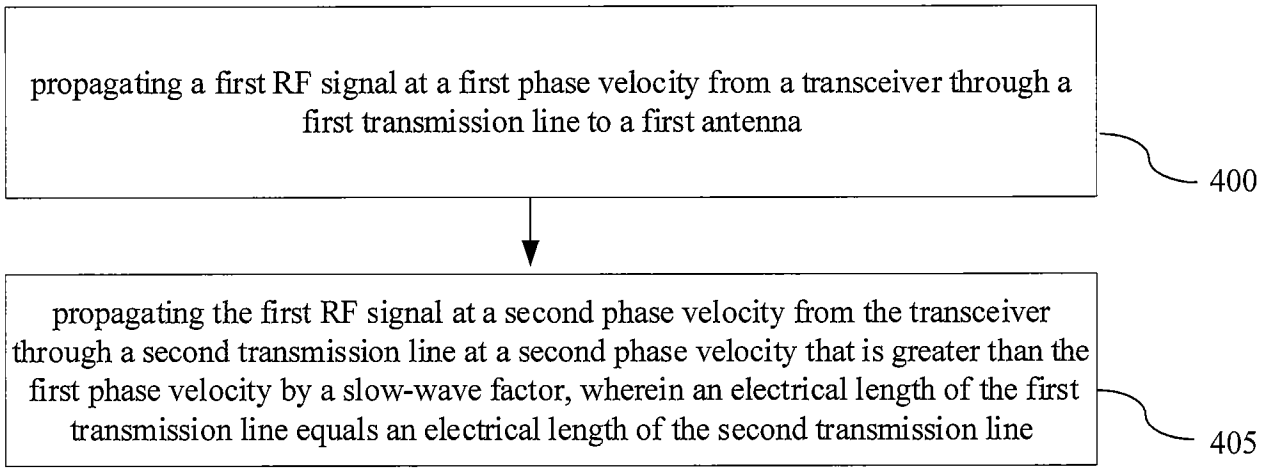
FIG. 4 is a flowchart for an example method of operation for an antenna array in accordance with an aspect of the disclosure.

A flowchart for a method of driving an antenna array through a transmission line network having both conventional and slow-wave transmission lines is shown in FIG. 4. The method includes an act 400 of propagating a first RF signal at a first phase velocity from a transceiver through a first transmission line to a first antenna. The propagation of an RF signal through first transmission line L1 to the first patch antenna is an example of act 400. The method also includes an act 405 of propagating a second RF signal at a second phase velocity that is greater than the first phase velocity by a slow-wave factor from the transceiver through a second transmission line, wherein an electrical length of the first transmission line equals an electrical length of the second transmission line. The propagation of an RF signal through either of second transmission line L2 or the third transmission line L3 is an example of act 405.

Figure 5:
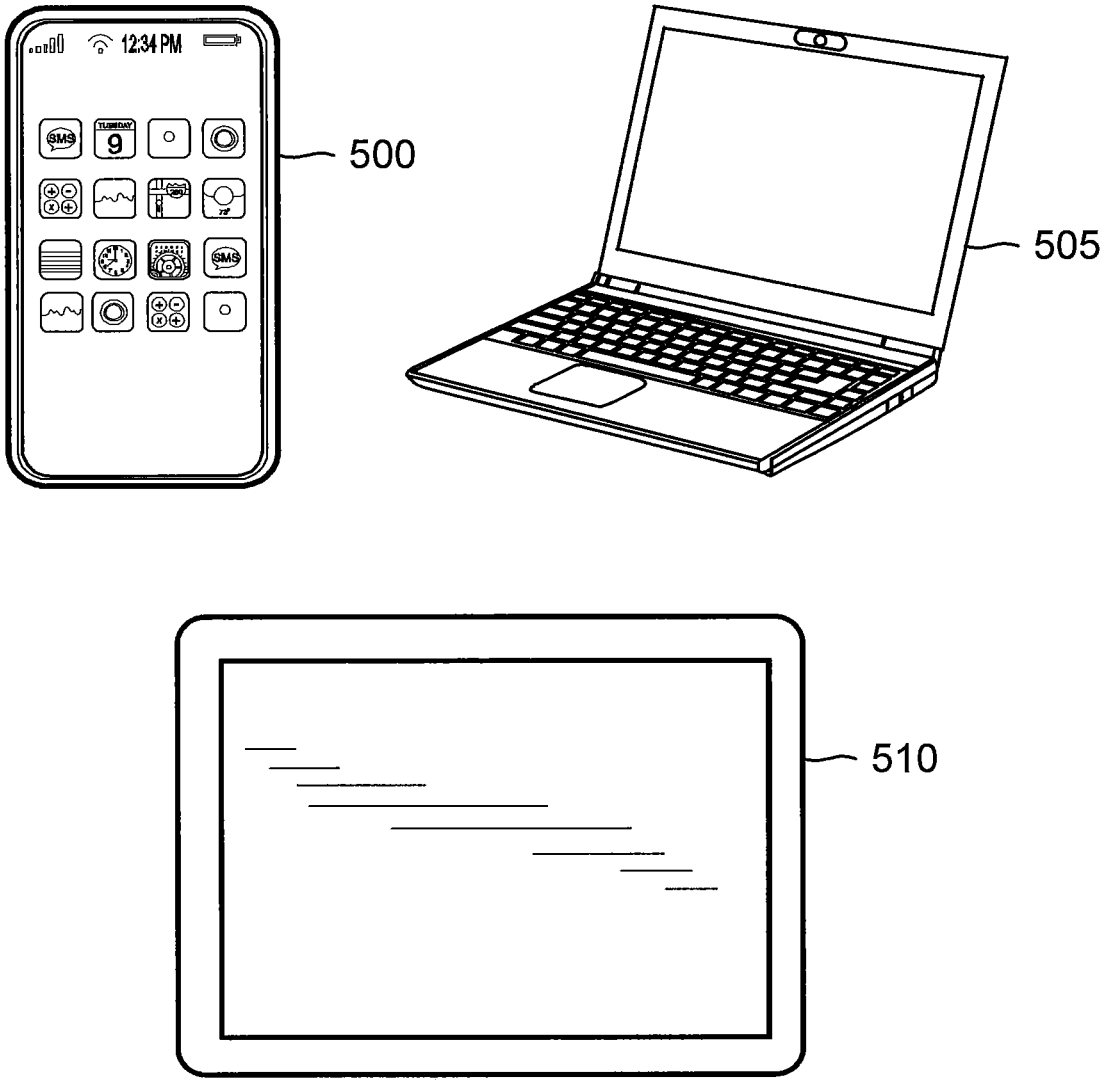
FIG. 5 illustrates some example electronic systems incorporating an antenna array in accordance with an aspect of the disclosure.

An antenna array as disclosed herein may be incorporated into a wide variety of electronic systems. For example, as shown in FIG. 5, a cellular device such as a cellular telephone 500, a laptop computer 505, and a tablet PC 510 may all include an antenna array in accordance with the disclosure. Other exemplary electronic systems such as a music player, a video player, a base station, and a personal computer may also be configured with antenna arrays constructed in accordance with the disclosure.

It will be appreciated that many modifications, substitutions and variations can be made in and to the materials, apparatus, configurations and methods of use of the devices of the present disclosure without departing from the scope thereof. In light of this, the scope of the present disclosure should not be limited to that of the particular embodiments illustrated and described herein, as they are merely by way of some examples thereof, but rather, should be fully commensurate with that of the claims appended hereafter and their functional equivalents.

What is claimed is:

1. An antenna array, comprising:

a substrate including a first terminal and a second terminal;

a first antenna;

a second antenna;

a first transmission line extending between the first terminal and the first antenna, wherein the first transmission line includes a first lead adjacent a first ground plane, and wherein the first lead is configured to provide the first transmission line with a first phase velocity; and a second transmission line extending between the second terminal and the second antenna, wherein the second transmission line includes a second lead adjacent the first ground plane, and wherein the second lead has a periodic structure configured to provide the second transmission line with a second phase velocity that is less than the first phase velocity, and wherein an electrical length of the first transmission line equals an electrical length of the second transmission line.

2. The antenna array of claim 1, wherein the second transmission line is a slow-wave transmission line, and wherein the first transmission line is not a slow-wave transmission line.

3. The antenna array of claim 1, wherein the periodic structure for the second lead comprises a plurality of longitudinally-extending leads and a plurality of transverse leads that extend in a transverse direction that is orthogonal to a longitudinal axis for the plurality of longitudinally-extending leads.

4. The antenna array of claim 3, wherein the plurality of transverse leads is arranged so that successive ones of the transverse leads in the plurality of transverse leads alternate between a positive transverse direction and a negative transverse direction.

5. The antenna array of claim 3, wherein a characteristic impedance of the first transmission line equals a characteristic impedance of the second transmission line.

6. The antenna array of claim 3, wherein the periodic structure for the second lead comprises a main lead and a plurality of capacitive stubs connected to the main lead.

7. The antenna array of claim 6, wherein each capacitive stub in the plurality of capacitive stubs extend in a transverse direction that is orthogonal to a longitudinal axis for the main lead.

8. The antenna array of claim 7, wherein each capacitive stub comprises a square patch.

9. The antenna array of claim 7, wherein a characteristic impedance of the first transmission line is greater than a characteristic impedance of the second transmission line.

10. The antenna array of claim 7, wherein the main lead includes a plurality of arcs corresponding to the plurality of capacitive stubs such that successive ones of the arcs in the plurality of arcs extend between successive ones of the capacitive stubs in the plurality of capacitive stubs.

11. The antenna array of claim 10, wherein a characteristic impedance of the first transmission line is equal to a characteristic impedance of the second transmission line.

12. The antenna array of claim 1, wherein the substrate is a circuit board substrate, and wherein the first ground plane comprises a patterned first metal layer adjacent the circuit board substrate, and wherein the first lead and the second lead comprise a patterned second metal layer separated from the patterned first metal layer by a dielectric layer.

13. The antenna array of claim 12, wherein the first transmission line and the second transmission line are microstrip lines.

14. The antenna array of claim 12, wherein the patterned second metal layer includes a second ground plane surrounding the first lead and the second lead, and wherein the first transmission line and the second transmission line are co-planar waveguides.

15. The antenna array of claim 12, further comprising a second ground plane covering the first lead and the second lead, and wherein the first transmission line and the second transmission line are striplines.

16. The antenna array of claim 1, wherein the antenna array is incorporated into a cellular device.

17. A method for an antenna array, comprising:

propagating a first RF signal at a first phase velocity from a transceiver through a first transmission line to a first antenna; and propagating a second RF signal at a second phase velocity that is greater than the first phase velocity by a slow-wave factor from the transceiver through a second transmission line, wherein an electrical length of the first transmission line equals an electrical length of the second transmission line.

18. The method of claim 17, wherein the second phase velocity is at least 25% greater than the first phase velocity.

19. An antenna array, comprising:

a substrate including a first terminal and a second terminal;

a first antenna and a second antenna adjacent the substrate, wherein the first antenna is separated from the first terminal by a first distance, and wherein the second antenna is separated from the second terminal by a second distance that is less than the first distance;

a fast-wave transmission line extending from the first terminal to the first antenna; and a slow-wave transmission line extending from the second terminal to the second antenna, wherein an electrical length of the fast-wave transmission line equals an electrical length of the slow-wave transmission line.

20. The antenna array of claim 19, wherein the first antenna and the second antenna are both patch antennas.

* * * * *